US011584971B2

(12) United States Patent
Denks et al.

(10) Patent No.: US 11,584,971 B2
(45) Date of Patent: Feb. 21, 2023

(54) HIGH-STRENGTH, HOT-ROLLED FLAT STEEL PRODUCT WITH HIGH EDGE CRACKING RESISTANCE AND, AT THE SAME TIME, HIGH BAKE-HARDENING POTENTIAL, AND METHOD FOR PRODUCING SUCH A FLAT STEEL PRODUCT

(71) Applicant: Salzgitter Flachstahl GmbH, Salzgitter (DE)

(72) Inventors: Ingwer Denks, Duisburg (DE); Joachim Schöttler, Duisburg (DE); Christian Pelz, Duisburg (DE); Patrick Witteler, Duisburg (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 152 days.

(21) Appl. No.: 16/772,586

(22) PCT Filed: Dec. 11, 2018

(86) PCT No.: PCT/EP2018/084406
§ 371 (c)(1),
(2) Date: Jun. 12, 2020

(87) PCT Pub. No.: WO2019/115551
PCT Pub. Date: Jun. 20, 2019

(65) Prior Publication Data

US 2020/0399727 A1 Dec. 24, 2020

(30) Foreign Application Priority Data

Dec. 15, 2017 (DE) ..... 10 2017 130 237.9

(51) Int. Cl.

| | |
|---|---|
| ***B32B 15/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/18*** | (2006.01) |

(52) U.S. Cl.
CPC ..... *C21D 8/0226* (2013.01); *C21D 8/0263* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/18* (2013.01); *C21D 2211/001* (2013.01); *C21D 2211/002* (2013.01); *C21D 2211/005* (2013.01); *C21D 2211/008* (2013.01); *C21D 2211/009* (2013.01); *Y10T 428/12799* (2015.01)

(58) Field of Classification Search
None
See application file for complete search history.

(56) References Cited

U.S. PATENT DOCUMENTS

| | | | | |
|---|---|---|---|---|
| 2002/0088510 | A1* | 7/2002 | Nagataki et al. | B32B 15/02 148/533 |
| 2008/0202645 | A1 | 8/2008 | Kawano et al. | |
| 2009/0071575 | A1* | 3/2009 | Su | C21D 1/00 148/537 |
| 2011/0315279 | A1* | 12/2011 | Kaneko | C22C 38/02 148/333 |
| 2014/0322559 | A1* | 10/2014 | Becker | C21D 6/002 148/333 |
| 2015/0122377 | A1* | 5/2015 | Bocharova | C22C 38/32 148/334 |

(Continued)

FOREIGN PATENT DOCUMENTS

| | | |
|---|---|---|
| CN | 106591696 A | 4/2017 |
| DE | 102012002079 | 8/2013 |
| EP | 0 559 225 | 9/1993 |

(Continued)

OTHER PUBLICATIONS

International Search Report issued by the European Patent Office in International Application PCT/EP2018/084406 dated Feb. 1, 2019.

(Continued)

*Primary Examiner* — Seth Dumbris

(74) *Attorney, Agent, or Firm* — Henry M. Feiereisen LLC

(57) ABSTRACT

A flat product of steel with yield strength Rp 0.2 of 660 to 820 MPa, BH2 value greater than 30 MPa, a hole expansion ratio greater than 30%, and a microstructure having a first main component at a proportion of at least 50%, including one or more individual components of ferrite, tempered bainite, and tempered martensite, each with less than 5% carbides, and a second main component at a proportion of 5% to 50%, including one or more individual components of martensite, residual austenite, bainite or perlite, with the steel having a following chemical composition (in weight %): C: 0.04 to 0.12; Si: 0.03 to 0.8; Mn: 1 to 2.5: P: max. 0.08; S: max. 0.01; N: max. 0.01; Al: up to 0.1; Ni+Mo; up to 0.5; Nb: up to 0.08; Ti: up to 0.2; Nb+Ti: min, 0.03; Cr: up to 0.6; the remainder being iron including unavoidable steel-associated elements.

17 Claims, No Drawings

(56) References Cited

U.S. PATENT DOCUMENTS

2018/0209011 A1* 7/2018 Denks ..... C23C 30/005

FOREIGN PATENT DOCUMENTS

| | | |
|---|---|---|
| EP | 0 945 522 | 9/1999 |
| EP | 1 808 505 | 7/2007 |
| EP | 2 524 970 | 11/2012 |
| EP | 2 546 368 | 1/2013 |
| RU | 2333284 C2 | 9/2008 |
| RU | 2554265 C2 | 6/2015 |
| WO | WO 2016/078642 | 5/2016 |
| WO | WO 2017/012958 | 1/2017 |

OTHER PUBLICATIONS

Russian Search Report dated Oct. 20, 2020 with respect to counterpart Russian patent application 2020114825/05(024640).
Translation of Russian Search Report dated Oct. 20, 2020 with respect to counterpart Russian patent application 2020114825/05(024640).

* cited by examiner

HIGH-STRENGTH, HOT-ROLLED FLAT STEEL PRODUCT WITH HIGH EDGE CRACKING RESISTANCE AND, AT THE SAME TIME, HIGH BAKE-HARDENING POTENTIAL, AND METHOD FOR PRODUCING SUCH A FLAT STEEL PRODUCT

CROSS-REFERENCES TO RELATED APPLICATIONS

This application is the U.S. National Stage of International Application No. PCT/EP2018/084406, filed Dec. 11, 2018, which designated the United States and has been published as International Publication No. WO 2019/115551 A1 and which claims the priority of German Patent Application, Serial No. 10 2017 130 237.9, filed Dec. 15, 2017, pursuant to 35 U.S.C. 119(a)-(d).

BACKGROUND OF THE INVENTION

The invention relates to a high-strength hot-roved flat steel product with high edge cracking resistance and, at the same time, high bake-hardening potential. Furthermore, the invention relates to a method for producing such a flat steel product.

In particular, the invention relates to flat steel products made from steels with a multi-phase microstructure which generally contains tempered bainite, and with an elasticity limit Rp0.2 in the range of 660 to 820 MPa, in particular for the production of components for automobile construction, which, in addition to a high tensile strength of at least 760 MPa and an elongation at fracture A80 of at least 10%, must have a high hole expansion capability with a hole expansion ratio of over 30% and a high bake-hardening potential with a BH2 value of over 30 MPa.

Bake-hardening effect (BH) is generally understood to mean a controlled ageing process which can be attributed to the carbon and/or nitrogen present in solution in the steel and is accompanied by an increase in the yield strength. The bake-hardening effect can be described by a BH2 value which is defined as the increase in the yield strength after a plastic pre-elongation of 2% and a subsequent heat treatment. The increase in the deflection strength of a component can be achieved e.g. with the bake-hardening effect in that, after formation into the component, a suitable heat treatment is carried out.

Bainitic steels are, according to EN 10346, steels which are characterized by a comparatively high yield strength and tensile strength with sufficiently high elongation for cold-forming processes. An effective welding capability is provided by reason of the chemical composition. The microstructure typically includes bainite with proportions of ferrite. The microstructure can contain in isolation small proportions of other phases, such as e.g. martensite and residual austenite. Such a steel is disclosed along with others e.g. in the laid-open document DE 10 2012 002 079 A1. However, a disadvantage with this is a still insufficiently high hole expansion capability.

The fiercely competitive car market means that producers are constantly forced to find solutions for reducing fleet fuel consumption and CO2 exhaust emissions whilst maintaining the highest possible level of comfort and passenger protection. On the one hand, the weight reduction of all of the vehicle components plays a decisive role as does, on the other hand, the most favorable possible behavior of the individual components in the event of high static and dynamic stress both during use of an automobile and also in the event of a crash.

By the provision of high-strength to ultra high-strength steels with strengths of up to 1200 MPa or more and the reduction in the sheet thickness it is possible to reduce the weight of vehicles by, at the same time, improving deformation behavior of the steels used and the component behavior during manufacture and in operation.

High-strength to ultra high-strength steels must meet comparatively high demands with respect to their strength, ductility and energy absorption, in particular during processing thereof, such as e.g. during stamping, hot and cold forming, during thermal tempering (e.g. air hardening, press hardening), welding and/or a surface treatment, e.g. a metallic finishing, organic coating or lacquering.

Thus, in addition to the required weight reduction by reduced sheet thicknesses, newly developed steels must meet the increasing material requirements for elasticity limit, tensile strength, solidification behavior and elongation at fracture while having good processing properties such as formability and weldability.

For such a reduction in sheet thickness, a high-strength to ultra high-strength steel with a single-phase or multi-phase microstructure must thus be used in order to ensure sufficient strength for the motor vehicle components and in order to meet the high deformation and component demands with respect to toughness, lack of sensitivity to edge cracking, improved bending angle and bending radius, energy absorption as well as solidification capability and the bake-hardening effect.

Improved joining suitability, in the form of better general welding capability, such as a larger usable welding area for resistance spot welding and improved failure behavior of the weld seam (fracture pattern) under mechanical stress, and sufficient resistant to delayed crack formation owing to hydrogen embrittlement are also required to an increasing extent.

The hole expansion capability is a material property which describes the resistance of the material to crack initiation and crack propagation in deformation operations in regions close to the edge, such as e.g. during plunging.

The hole expansion test is regulated e.g. in the ISO 16630 standard. Accordingly, holes which are stamped into a metal sheet are expanded by means of a mandrel. The measurement variable is the change in hole diameter, related to the initial diameter, at which the first crack through the metal sheet occurs at the edge of the hole.

Improved edge crack insensitivity signifies an increased deformation capability of the sheet edges and can be described by an increased hole expansion capability. This situation is known under the synonyms "Low Edge Crack" (LEC) or "High Hole Expansion" (HHE) and xpand®.

On this basis, the object of the present invention is to create a high-strength, hot-rolled flat steel product with good deformation properties, in particular with high edge cracking resistance and with high bake-hardening potential, and a method for producing such a flat steel product, which offer a good combination of strength and deformation properties in relation to the steel.

SUMMARY OF THE INVENTION

In accordance with one aspect of the invention, the object is achieved by a high-strength, hot-rolled flat steel product with high edge cracking resistance made from a steel with an elasticity limit Rp0.2 of 660 to 820 MPa, a BH2 value of over 30 MPa and a hole expansion ratio of over 30% as well as a microstructure comprised of two main components, wherein a first main component of the microstructure comprises a proportion of at least 50%, comprised of one or a plurality of individual components of ferrite, tempered bainite and tempered martensite each with less than 5% carbides, and wherein a second main component of the microstructure comprises a proportion of 5% to at most 50%, comprised of one or a plurality of individual components of martensite, residual austenite, bainite or perlite, with the following chemical composition of the steel (in wt. %):

C: 0.04 to 0.12
Si: 0.03 to 0.8
Mn: 1 to 2.5
P: max. 0.08
S: max. 0.01
N: max. 0.01
Al: up to 0.1
Ni+Mo: up to 0.5
Nb: up to 0.08
Ti: up to 0.2
Nb+Ti: min. 0.03
Cr: up to 0.6, with the remainder being iron including unavoidable steel-associated elements, offers a good combination of strength, elongation and deformability properties. Furthermore, the production of this flat steel product in accordance with the invention based on the alloy elements C, Si, Mn, Nb and/or Ti is comparatively inexpensive.

Advantageous embodiments of the invention are described in dependent claims.

The flat steel product in accordance with the invention is characterized preferably also by a high hole expansion ratio of over 30% with at the same time high tensile strength of 760 to 960 MPa and high bake-hardening potential BH2 of over 30 MPa.

In one advantageous development of the invention, in order to achieve particularly favorable combinations of properties, the flat steel product contains the following alloy composition in wt. %: C: 0.04 to 0.08, Si: 0.03 to 0.4, Mn: 1.4 to 2.0, P: max. 0.08, S: max. 0.01, N: max. 0.01, Al: up to 0.1, Ni+Mo: up to 0.5, Nb: up to 0.08, Ti: up to 0.2, Nb+Ti: min. 0.03 and particularly advantageously: C: 0.04 to 0.08, Si: 0.03 to 0.4, Mn: 1.4 to 2.0, P: max. 0.08, S: max. 0.01, N: max. 0.01, Al: up to 0.1, Ni+Mo: up to 0.5, Nb: up to 0.05 Ti: up to 0.15, Nb+Ti: min. 0.03.

The use of the term to in the definition of the content ranges, such as e.g. 0.01 to 1 wt. %, means that the limit values—0.01 and 1 in the example—are also included. The microstructure includes two main components, wherein a first main component makes up a proportion of >=50% with one or a plurality of microstructure components ferrite and tempered bainite and tempered martensite and each with <5% carbides and the second main component makes up a proportion of 5%-50% and includes one or a plurality of microstructure components martensite, residual austenite, bainite or perlite and preferably on average comprises a comparatively higher carbon content than the first main component.

The comparatively carbon-richer second main component is advantageously embedded hi an island-like manner in the comparatively carbon-poorer first main component forming the matrix. The island size is comparatively small, having a diameter of ca. 1 μm but in each case <2 μm, and the islands are advantageously distributed uniformly over the strip thickness. The small size of the islands and the homogeneous distribution of the second main component contribute considerably to the achievement of the high hole expansion ratio.

By the proportion of the carbon-richer second main component embedded in an island-like manner in the matrix, firstly the yield strength in the said region and secondly the bake-hardening potential is adjusted. The metal-related mechanism resides in the fact that, with the formation of the metastable microstructure components martensite, residual austenite and bainite, a large number of dislocations are produced which lead to a low elasticity limit. During the bake-hardening process, dissolved carbon diffuses from the metastable microstructure components martensite, residual austenite and bainite into the previously occurring dislocations and causes the known increase in strength. Since there is no dissolved carbon available in the perlite, the carbon-rich component embedded in an island-like manner in the matrix contains at least one of the metastable microstructure components martensite, residual austenite and bainite.

The hot-rolled flat steel product in accordance with the invention can be provided with a metallic or non-metallic coating and is suitable in particular for producing components for vehicle construction in the automobile industry but applications in the field of ship building, plant construction, infrastructure building, in the aerospace industry and in household appliance technology are also feasible.

In an advantageous manner, the steel has, in the rolling direction, a tensile strength Rm of 760 to 960 MPa, an elasticity limit Rp0.2 of 660 to 820 MPa, an elongation at fracture A80 of more than 10%, preferably more than 12%, a hole expansion ratio of over 30% and a BH2 value of over 30 MPa.

Alloy elements are generally added to the steel in order to influence specific properties in a targeted manner. An alloy element can thereby influence different properties in different steels. The effect and interaction generally depend greatly upon the quantity, presence of further alloy elements and the solution state in the material. The correlations are varied and complex. The effect of the alloy elements in the alloy in accordance with the invention will be discussed in greater detail hereinafter. The positive effects of the alloy elements used in accordance with the invention will be described hereinafter:

Carbon C: is required to form carbides, in particular in conjunction with the so-called microalloy elements Nb, V and Ti, requires the formation of martensite and bainite, stabilizes the austenite and generally increases strength. Higher contents of C impair the welding properties and result hi the impairment of the elongation and toughness properties, for which reason a maximum content of less than 0.12 wt. %, advantageously of less than 0.08 wt. %, is set. In order to achieve a sufficient strength for the material, a minimum addition of 0.04 wt. % is required.

Manganese Mn: stabilizes the austenite, increases strength and toughness and increases the temperature window for the hot rolling below the recrystallization stop temperature. Higher contents of >2.5 wt. % Mn increase the risk of middle segregations which significantly reduce the ductility and therefore the product quality. Lower contents <1.0 wt. % do not allow the required strength and toughness to be achieved at the desired moderate analysis costs. A content of Mn in the range between 1.4 wt. % and 2.0 wt. % is advantageous.

Aluminium Al: is used for deoxidation in the steel works process. The quantity of Al used is process-dependent. Thus no minimum Al content is given. An Al content of greater than 0.1 wt. % considerably impairs the casting behavior in the continuous casting process. This gives rise to increased effort when casting.

Silicon Si: belongs to the elements which permit an increase in the strength of steel by mixed crystal hardening in an inexpensive manner. However, Si reduces the quality of the surface of the hot strip by the conveying of firmly adhering scale on the reheated slabs, which, in the case of high Si contents, can be removed only with a considerable effort or may only be removed to an insufficient degree. This is disadvantageous particularly in the case of subsequent galvanizing. Thus the Si content is limited to a maximum of 0.8%, advantageously to 0.4%. If Si is largely dispensed with by reason of surface considerations, a lower limit of 0.03 is considered to be useful, since, where the Si content is more greatly reduced, comparatively high processing costs arise at the steel works.

Chromium Cr: improves the strength and reduces the rate of corrosion, delays the formation of ferrite and perlite and forms carbides. The maximum content is set to less than 0.6 wt. %, since higher contents result in an impairment in ductility.

Molybdenum Mo: increases the hardenability or decreases the critical cooling rate and thus promotes the formation of fine bainite microstructures. Furthermore, the use of small quantities of Mo already delays the coarsening of fine precipitations which should be as fine as possible in order to increase the strength of microalloyed microstructures.

Nickel Ni: the use of already low quantities of Ni promotes ductility while leaving the strength unchanged. Owing to the comparatively high costs, the content of Ni+Mo is limited to 0.5 wt. %.

Phosphorus P: is a trace element from iron ore and is dissolved in the iron lattice as a substitution atom. Phosphorus increases hardness by means of mixed crystal hardening and improves hardenability. However, attempts are generally made to lower the phosphorus content as much as possible because inter alia it exhibits a strong tendency towards segregation and greatly reduces the level of toughness. The attachment of phosphorus to the grain boundaries can cause cracks along the grain boundaries during hot rolling. Moreover, phosphorus increases the transition temperature from tough to brittle behavior by up to 300° C. However, by targeted measures, which are precisely controlled in terms of processing, the use of low quantities of P also makes possible an inexpensive increase in strength. For the aforementioned reasons, the phosphorus content is limited to less than 0.08 wt. %.

Sulphur S: like phosphorous, is bound as a trace element in the iron ore. It is generally not desired in steel since it leads to undesired inclusions of MnS, whereby the elongation and toughness properties are adversely affected. It is thus attempted to achieve the lowest possible quantities of sulphur in the melt and possibly to transform the elongated inclusions by so-called Ca treatment into a more favorable geometric form. For the aforementioned reasons, the sulphur content is limited to less than 0.01 wt. %.

Nitrogen N: is likewise an associated element from steel production. Steels with free nitrogen tend to have a strong ageing effect. The nitrogen diffuses even at low temperatures to dislocations and blocks same. It thus produces an increase in strength associated with a rapid loss of toughness. Binding of the nitrogen in the form of nitrides is possible e.g. by addition by alloying of aluminium, niobium or titanium. However, the stated alloy elements are subsequently no longer available later in the process for new formation of small precipitations which are very efficient with respect to strength. For the aforementioned reasons, the nitrogen content is limited to less than 0.01 wt. %.

Microalloy elements are generally added only in very small amounts (<0.2 wt. % per element). In contrast to the alloy elements, they mainly act by precipitate formation but can also influence the properties in the dissolved state. Despite the small amounts added, microalloy elements greatly influence the target-orientated production conditions and the processing properties and final properties of the product.

Typical microalloy elements are e.g. niobium and titanium. These elements can be dissolved in the iron lattice and form carbides, nitrides and carbonitrides with carbon and nitrogen.

The effect of Nb and Ti depends in particular on how the processing is carried out during hot-rolling and subsequent cooling. The addition of microalloy elements seeks to achieve grain refinement during the process and to produce precipitations in the nanometer size range. Thus a minimum content Nb+Ti of 0.03 wt. % is a prerequisite for achieving the desired strength and elongation properties.

Niobium Nb: The addition by alloying of niobium acts in a grain-refining manner in particular by forming carbides, whereby at the same time the strength, toughness and elongation properties are improved. In the case of contents of over 0.08 wt. %, a saturation behavior sets in, for which reason a maximum content of less than or equal to 0.08 wt. % is provided.

Titanium Ti: acts in a grain-refining manner as a carbide-forming agent, whereby at the same time the strength, toughness and elongation properties are improved. Contents of Ti of more than 0.2 wt. % impair the ductility and hole expansion capability by the formation of coarse primary TiN precipitations, for which reason a maximum content of 0.2 wt. % is set.

In accordance with one aspect of the invention, the object is achieved by a method for producing the above-described hot-rolled flat steel product in accordance with the invention, which method comprises the steps of:

melting a steel melt containing (in wt. %):

C: 0.04 to 0.12
Si: 0.03 to 0.8
Mn: 1 to 2.5
P: max. 0.08
S: max. 0.01
N: max. 0.01
Al: up to 0.1
Ni+Mo: up to 0.5
Nb: up to 0.08
Ti: up to 0.2
Nb+Ti: min. 0.03
Cr: up to 0.6, with the remainder being iron including unavoidable steel-associated elements, casting the steel melt to form a slab or thin slab by means of a horizontal or vertical slab or thin slab casting process, reheating the slab or thin slab to 1050° C. to 1270° C. and then hot-rolling the slab or thin slab to form a hot strip with optional intermediate heating between individual rolling passes of the hot-rolling, rolling in the last rolling pass at a final rolling temperature of less than 950° C. and greater than Ar1+50K, preferably at less than 950° C. and greater than Ar3, wherein Ar3 during cooling describes the beginning of the conversion and Ar1 describes the end of the conversion from austenite into ferrite, reeling the hot strip at a reeling temperature below 650° C., preferably in a temperature range of 450° C. to 600° C., annealing the hot strip above Ac1 and below Ac1+100° C. with an annealing time of at least 1 s, preferably 5 s–40 s and an average cooling rate between annealing temperature and 500° C. of 0.1 K/min to 150 K/s, preferably 5 K/s to 20 K/s, optionally hot-dip coating the heated hot strip after annealing and cooling to ≤500° C.

Advantageous embodiments of the invention are described in dependent claims.

Within the scope of current experimentation it has been found to be essential that the ferritic-bainitic, microalloyed hot strip substantially retains the mechanical properties although—unusually—annealing is carried out at temperatures below Ac1 but at Ac1<T<Ac1+100° C.

Thus the temperature Ac1 describes the beginning of the conversion of the microstructure into austenite under slow heating according to relevant standards. Ac1 is generally determined by dilatometric measurements.

In accordance with the invention it has been recognized that during annealing from T<Ac1, the homogeneity of the ferritic-bainitic microstructure does remain largely unchanged and so in particular the level of the hole expansion ratio, which is comparatively high with mainly bainitic microstructures, is retained. However, in the case of annealing below Ac1 a BH2 value of >30% cannot be achieved and a pronounced upper yield strength of ReH>820 MPa is formed which is often seen as problematic for the user. The cause is the blocking of dislocations by diffusion of atomically dissolved carbon in the case of annealing at T<Ac1 or galvanization at T>400° C.

Within the framework of the invention it has surprisingly been discovered that in the case of annealing in the temperature range of Ac1<T<Ac1+100° C., both a high level of the hole expansion ratio of >30% and also a BH2 value of >30 MPa in combination can be achieved. With the steel in accordance with the invention, a reeling temperature HT of less than 650°, advantageously in the range of 450° C. to 600° C. proves to be advantageous, since the predominantly bainitic microstructure thus adjusted provides a high number of nucleation sites for the conversion into austenite at T>Ac1 and thus the island diameter of the embedded second phase permits an average value of <1 μm. Below 450° C. a comparatively high proportion of martensite is to be expected, which is disadvantageous after heat treatment with respect to ductility and hole expansion capability owing to the internal structure.

The hot-rolling final temperature in this steel lies, in accordance with the invention, between 950° C. and Ar1+50 K, wherein Ar1 describes the beginning of the conversion of austenite into ferrite during cooling.

Conventional thickness ranges for slabs and thin slabs are between 35 mm to 450 mm. Provision is made that the slab or thin slab is hot-rolled to form a hot strip with a thickness of from 1.5 mm to 8 mm, preferably 1.8 mm to 4.5 mm.

After hot-rolling, the hot strip is reeled in accordance with the invention at a reeling temperature of preferably 450° C. to 650° C. In order to achieve the required property combination for the hole expansion ratio, the BH2 value and the other mechanical properties, the hot-rolled flat steel product is subjected to a heat treatment in accordance with the invention in the temperature range Ac1<T<Ac1+100° C. and is generally kept in this temperature range for 10 seconds to 10 minutes, possibly up to 48 hours, wherein higher temperatures are allocated to shorter treatment times and vice versa. Annealing will generally be effected in a continuous annealing process (shorter annealing times) but can also be effected e.g. in a batch-type annealing process (longer annealing times).

Preferably, the flat steel product is galvanized by hot-dipping or electrolytically or is coated metallically, inorganically or organically. In a hot-dip coating procedure, the annealing preferably takes place in a continuous annealing Installation upstream of the hot-dip coating installation.

A hot-rolled flat steel product produced by the method in accordance with the invention has a tensile strength Rm of the flat steel product of 760 to 960 MPa and an elongation at fracture A80 of more than 10%, preferably more than 12%. In this case, high levels of strength and small sheet thicknesses tend to be associated with lower elongations at fracture and vice versa.

In relation to other advantages, reference is made to the above statements relating to the steel in accordance with the invention.

Using a hot-strip produced in accordance with the invention from two steels with different analyses A and B according to table 1, the mechanical characteristic values and the values for the bake-hardening (BH2) and the hole expansion ratios (HER) have been determined.

TABLE 1

| Steel | C | Si | Mn | P | S | N | Al | Mo | Ti | Nb |
|---|---|---|---|---|---|---|---|---|---|---|
| A | 0.08 | 0.5 | 1.9 | 0.01 | 0.001 | 0.006 | 0.08 | 0.15 | 0.13 | 0.05 |
| B | 0.06 | 0.6 | 1.9 | 0.01 | 0.004 | 0.004 | 0.06 | 0.19 | 0.11 | 0.04 |

Table 2 shows the results for annealing of the hot strip in accordance with the invention at Ac1<T<Ac1-100° C. (invention) compared to annealing below an Ac1 annealing temperature (comparison) in a radiant tube furnace (RTF). In the case of annealing in accordance with the invention, all required characteristic values are safely reached.

TABLE 2

| Dwell time 5 s-40 s, cooling rate 5 K/s-20 K/s | | | | | | | | | | | |
|---|---|---|---|---|---|---|---|---|---|---|---|
| Steel | Thickness [mm] | T(RTF) [° C.] | ΔT with respect to AC1 [° C.] | ReL [MPa] | ReH [MPa] | Rp0.2 [MPa] | Rm [MPa] | A80 [%] | BH2 [MPa] | HER [%] | |
| A | 2.2 | 680 | −40 | 842 | 905 | 855 | 874 | 14.3 | 16 | 49 | Comparison |
| A | 2.2 | 710 | −10 | 842 | 898 | 858 | 880 | 14.2 | 9 | 45 | Comparison |
| A | 2.2 | 740 | 20 | 776 | 786 | 783 | 926 | 12.8 | 90 | 32 | Invention |
| A | 2.2 | 770 | 50 | none | none | 667 | 900 | 11.0 | 80 | 35 | Invention |
| B | 2.2 | 680 | −44 | 829 | 859 | 839 | 883 | 14.0 | 13 | 72 | Comparison |
| B | 2.2 | 710 | −14 | 837 | 861 | 839 | 886 | 13.6 | 17 | 51 | Comparison |
| B | 2.2 | 740 | 16 | 791 | 804 | 795 | 893 | 13.6 | 44 | 51 | Invention |

TABLE 2-continued

| Dwell time 5 s-40 s, cooling rate 5 K/s-20 K/s | | | | | | | | | | | |
|---|---|---|---|---|---|---|---|---|---|---|---|
| Steel | Thickness [mm] | T(RTF) [° C.] | ΔT with respect to AC1 [° C.] | ReL [MPa] | ReH [MPa] | Rp0.2 [MPa] | Rm [MPa] | A80 [%] | BH2 [MPa] | HER [%] | |
| B | 2.2 | 770 | 46 | none | none | 703 | 882 | 12.9 | 66 | 43 | Invention |
| B | 2.2 | 800 | 76 | 656 | 666 | 668 | 828 | 12.4 | 82 | 54 | Invention |
| B | 2.2 | 839 | 118 | none | none | 565 | 771 | 15.3 | 65 | 55 | Comparison |
| B | 2.2 | 753 | 29 | none | none | 727 | 873 | 12.7 | 76 | 65 | Invention |
| B | 2.2 | 752 | 28 | 779 | 783 | 753 | 884 | 13 | 74 | 73 | Invention |
| B | 3.4 | 680 | −44 | 894 | 929 | 892 | 926 | 14.9 | 25 | 53 | Comparison |
| B | 3.4 | 710 | −14 | 883 | 909 | 890 | 924 | 14.6 | 34 | 59 | Comparison |
| B | 3.4 | 770 | 46 | 768 | 772 | 769 | 896 | 13.2 | 72 | 49 | Invention |
| B | 3.4 | 800 | 76 | 718 | 742 | 719 | 834 | 14.1 | 87 | 50 | Invention |

What is claimed is:

1. A high-strength, hot-rolled flat steel product having high edge cracking resistance and made from a steel with a tensile strength of at least 760 MPa, an elasticity omit Rp0.2 of 660 to 820 MPa, a bake-hardening potential BH2 value of over 30 MPa, wherein the BH2 value is defined as the increase in the yield strength after a plastic pre-elongation of 2% and a subsequent heat treatment, and a hole expansion ratio of over 30%, said steel having a microstructure comprised of two main components, with a first one of the main components of the microstructure provided at a proportion of at least 50% and including at least one individual component selected from the group consisting of ferrite, tempered bainite, and tempered martensite and having less than 5% carbides, and with a second one of the main components of the microstructure provided at a proportion of 5% to 50% and including at least one individual component selected from the group consisting of martensite, residual austenite, bainite, and perlite, said steel comprising a following chemical composition (in wt. %):

C: 0.04 to 0.12
Si: 0.03 to 0.8
Mn: 1 to 2.5
P: max. 0.08
S: max. 0.01
N: max. 0.01
Al: up to 0.1
Ni+Mo: up to 0.5
Nb: up to 0.08
Ti: up to 0.2
Nb+Ti: min. 0.03
Cr: up to 0.6,
with the remainder being iron including unavoidable steel-associated elements, wherein the first main component of the microstructure is formed as a matrix, said second main component of the mocrostructure being embedded in the form of at least one island into the first main component of the microstructure and wherein the at least one island has a size of less than 2 μm.

2. The fiat steel product of claim 1, wherein the steel contains (in wt. %):

C: 0.04 to 0.08
Si: 0.03 to 0.4
Mn: 1.4 to 2.0
P: max. 0.08
S: max. 0.01
N: max. 0.01
Al: up to 0.1
Ni+Mo: up to 0.5
Nb: up to 0.08
Ti: up to 0.2
Nb+Ti: min. 0.03.

3. The flat steel product of claim 1, wherein the steel contains (in wt. %):

C: 0.04 to 0.08
Si: 0.03 to 0.4
Mn: 1.4 to 2.0
P: max. 0.08
S: max. 0.01
N: max. 0.01
Al: up to 0.1
Ni+Mo: up to 0.5
Nb: up to 0.05
Ti: up to 0.15
Nb+Ti: min. 0.03.

4. The fiat steel product of claim 1, wherein the at least one island has a size of less than 1 μm.

5. The flat steel product of claim 1, having a tensile strength Rm of 760 to 960 MPa and an elongation at fracture A8 of more than 10%.

6. The flat steel product of claim 1, having a tensile strength Rm of 760 to 960 MPa and an elongation at fracture A8 of more than 12%.

7. The flat steel product of claim 1, wherein the steel product is galvanized by hot-dipping or electrolytically or is coated metallically, inorganically or organically.

8. The flat steel product of claim 1, wherein the second main component has a carbon content which on average is higher than a carbon content of the first main component.

9. A method for producing a hot-rolled flat steel product as set forth in claim 1, said method comprising:

melting a steel melt containing (in wt. %):
C: 0.04 to 0.12
Si: 0.03 to 0.8
Mn: 1 to 2.5
P: max. 0.08
S: max. 0.01
N: max. 0.01
Al: up to 0.1
Ni+Mo: up to 0.5
Nb: up to 0.08
Ti: up to 0.2
Nb+Ti: min. 0.03
Cr: up to 0.6,
with the remainder being iron including unavoidable steel-associated elements;
casting the steel melt to form a slab or thin slab by a horizontal or vertical slab or thin slab casting process;

reheating the slab or thin slab to a temperature of 1050° C. to 1250° C.;

hot-rolling the slab or thin slab to form a hot strip;

rolling in a last rolling pass at a final rolling temperature of less than 950° C. and greater than Ar3;

reeling the hot strip at a reeling temperature of below 650° C.; and annealing the hot strip above Ac1 and below Ac1+100° C. with an annealing time of 10 seconds to 10 minutes and an average cooling rate between an annealing temperature and 500° C. of 1 K/s to 150 K/s.

10. The method of claim 9, further comprising intermediate heating of the slab or thin slab between individual rolling passes as the slab or thin slab undergoes hot-rolling.

11. The method of claim 9, wherein the hot strip is reeled at a reeling temperature in a range of 450° C. to 600° C.

12. The method of claim 9, wherein the hot strip undergoes an average cooling rate between the annealing temperature and 500° C. of 5 K/s to 20 K/s.

13. The method of claim 9, further comprising hot-dip coating the hot strip directly after undergoing a cooling process at the average cooling rate to a cooling stop temperature in a continuous hot-galvanizing installation.

14. The method of claim 9, wherein the hot strip is rolled with a final rolling temperature of greater than Ac1+50° C.

15. The method of claim 9, wherein the slab or thin slab is hot-rolled to form the hot strip with a thickness of 1.5 mm to 8 mm.

16. The method of claim 9, wherein the slab or thin slab is hot-rolled to form the hot strip with a thickness of 1.8 mm to 4.5 mm.

17. A high-strength, hot-rolled flat steel product having high edge cracking resistance and made from a steel with a tensile strength of at least 760 MPa, an elasticity limit Rp0.2 of 660 to 820 MPa, a bake-hardening potential BH2 value of over 30 MPa, wherein the BH2 value is defined as the increase in the yield strength after a plastic pre-elongation of 2% and a subsequent heat treatment, and a hole expansion ratio of over 30%, said steel having a microstructure comprised of two main components, with a first one of the main components of the microstructure provided at a proportion of at least 50% and including at least one individual component selected from the group consisting of ferrite, tempered bainite, and tempered martensite and having less than 5% carbides, and with a second one of the main components of the microstructure provided at a proportion of 5% to 50% and including at least one individual component selected from the group consisting of martensite, residual austenite, bainite, and perlite, said steel comprising a following chemical composition (in wt. %):

C: 0.04 to 0.08
Si: 0.03 to 0.4
Mn: 1.4 to 2.0
P: max. 0.08
S: max. 0.01
N: max. 0.01
Al: up to 0.1
Ni+Mo: up to 0.5
Nb: up to 0.08
Ti: up to 0.2
Nb+Ti: min. 0.03
Cr: up to 0.6, with the remainder being iron including unavoidable steel-associated elements.

* * * * *